US008240394B2

(12) United States Patent
Kobayashi

(10) Patent No.: US 8,240,394 B2
(45) Date of Patent: Aug. 14, 2012

(54) HAMMER WITH VIBRATION REDUCTION MECHANISM

(75) Inventor: Shigeki Kobayashi, Nagano (JP)

(73) Assignee: SP Air Kabushiki Kaisha, Nagano (JP)

( * ) Notice: Subject to any disclaimer, the term of this patent is extended or adjusted under 35 U.S.C. 154(b) by 395 days.

(21) Appl. No.: 12/579,077

(22) Filed: Oct. 14, 2009

(65) Prior Publication Data

US 2010/0139940 A1 Jun. 10, 2010

Related U.S. Application Data

(60) Provisional application No. 61/121,047, filed on Dec. 9, 2008.

(51) Int. Cl.
*B25D 17/00* (2006.01)

(52) U.S. Cl. ..... 173/162.1; 173/162.2; 173/211; 227/10

(58) Field of Classification Search ..... 173/162.1, 173/162.2, 168, 169, 210, 211; 227/10
See application file for complete search history.

(56) References Cited

U.S. PATENT DOCUMENTS

| | | | | |
|---|---|---|---|---|
| 2,559,478 | A * | 7/1951 | Stone | 173/202 |
| 2,899,934 | A * | 8/1959 | Salengro | 173/18 |
| 3,446,291 | A * | 5/1969 | Wickersheim et al. | 173/17 |
| 3,469,757 | A * | 9/1969 | Caro et al. | 227/10 |
| 4,071,094 | A | 1/1978 | Kilin et al. | |
| 4,140,446 | A | 2/1979 | Fernstrom et al. | |
| 4,308,926 | A | 1/1982 | Montabert | |
| 4,493,376 | A * | 1/1985 | Kopf | 173/210 |
| 4,723,610 | A * | 2/1988 | Dummermuth et al. | 173/1 |
| 4,867,252 | A | 9/1989 | Sudnishnikov et al. | |
| 4,936,393 | A | 6/1990 | Lister | |
| 5,170,922 | A * | 12/1992 | Ehmig et al. | 227/8 |
| 5,417,294 | A | 5/1995 | Suher | |
| 5,533,579 | A | 7/1996 | Chu | |
| 5,573,075 | A | 11/1996 | Henry et al. | |
| 5,626,199 | A | 5/1997 | Henry et al. | |
| 5,797,462 | A | 8/1998 | Rahm | |
| 6,161,628 | A * | 12/2000 | Liu | 173/168 |
| 6,192,997 | B1 * | 2/2001 | Tsai et al. | 173/211 |
| 6,209,659 | B1 | 4/2001 | Blessing | |
| 6,530,435 | B1 | 3/2003 | Lindsay | |
| 6,763,897 | B2 | 7/2004 | Hanke et al. | |
| 6,827,156 | B1 | 12/2004 | Hsiao | |
| 7,023,952 | B2 | 4/2006 | Brunnett | |
| 7,143,840 | B2 * | 12/2006 | Mikiya et al. | 173/132 |
| 7,234,379 | B2 | 6/2007 | Claesson et al. | |
| 7,322,428 | B2 * | 1/2008 | Bacila | 173/162.2 |

* cited by examiner

*Primary Examiner* — Scott A. Smith
(74) *Attorney, Agent, or Firm* — Senniger Powers LLP

(57) ABSTRACT

A power-driven hammer including a body including a tubular housing and a barrel assembly received in the housing. The barrel assembly has an at-rest position relative to the housing. The barrel assembly includes a barrel having a forward end adapted to hold a tool, an opening, and a rearward end. The barrel assembly includes a mass received in the opening of the barrel. The mass moves in the barrel opening when the hammer is operating through a power stroke and a return stroke. The barrel assembly moves forward and rearward from its at-rest position relative to the housing when the hammer is operating. The hammer includes a vibration reducing mechanism connecting the barrel assembly to the body reducing shock transmitted to the housing as the mass moves forward and rearward in the barrel.

10 Claims, 3 Drawing Sheets

HAMMER WITH VIBRATION REDUCTION MECHANISM

CROSS-REFERENCE TO RELATED APPLICATION

Priority is claimed from U.S. Provisional Patent Application Ser. No. 61/121,047 filed Dec. 9, 2008, which is hereby incorporated by reference.

FIELD OF THE INVENTION

The present invention generally relates to a hammer having a vibration reduction mechanism.

BACKGROUND OF THE INVENTION

In general, a hammer such as a pneumatic hammer repeatedly strikes a mass against an output member, such as a chisel. The mass may strike the output member as many as 2000 times per minute, imparting energy to the output member each time the mass strikes. In the case of a chisel output member, the energy drives the chisel against material being chiseled so the chisel cuts or breaks the material. This rapid and repeated striking also produces vibrations that are transmitted through the hammer to a user holding the hammer. The vibrations may make it difficult for the user to use the hammer for extended periods of time.

SUMMARY OF THE INVENTION

The present invention includes a power-driven hammer comprising a body including a tubular housing and a barrel assembly received in the housing. The barrel assembly has an at-rest position relative to the housing when the hammer is not operating. The barrel assembly comprises a barrel having a forward end adapted to hold a tool, an opening, and a rearward end opposite the forward end. The barrel assembly also comprises a mass received in the opening of the barrel. The mass moves in the barrel opening when the hammer is operating through a power stroke, in which the mass moves toward the forward end of the barrel to strike the tool when held in the barrel. The mass moves in the barrel opening when the hammer is operating through a return stroke, in which the mass moves toward the rearward end of the barrel. The barrel assembly moves forward and rearward from its at-rest position relative to the housing when the hammer is operating. The hammer includes a vibration reducing mechanism connecting the barrel assembly to the body reducing shock transmitted to the housing as the mass moves forward and rearward in the barrel.

In another aspect, the present invention includes a power-driven hammer comprising a housing and a barrel assembly mounted on the housing having an at-rest position with respect to the housing when the hammer is not operating. The barrel assembly comprises a barrel having a forward end, an opening, and a rearward end opposite the forward end. Further, the barrel assembly includes a mass moveably received in the barrel opening. The mass oscillates back and forth in the barrel opening between a power stroke and a return stroke. The barrel assembly moves forward and rearward from its at-rest position relative to the housing when the hammer is operating. In addition, the barrel assembly comprises a vibration reducing mechanism mounted between the barrel assembly and the housing comprising. The vibration reducing mechanism includes a fastener having a head mounted on the barrel assembly and slidably received by the housing. The mechanism also includes a first spring held by the fastener between the barrel assembly and the housing and a second spring held by the fastener between the housing and the head of the fastener.

BRIEF DESCRIPTION OF THE DRAWINGS

Corresponding reference characters indicate corresponding parts throughout the drawings.

DETAILED DESCRIPTION OF THE DRAWINGS

Figure 1:
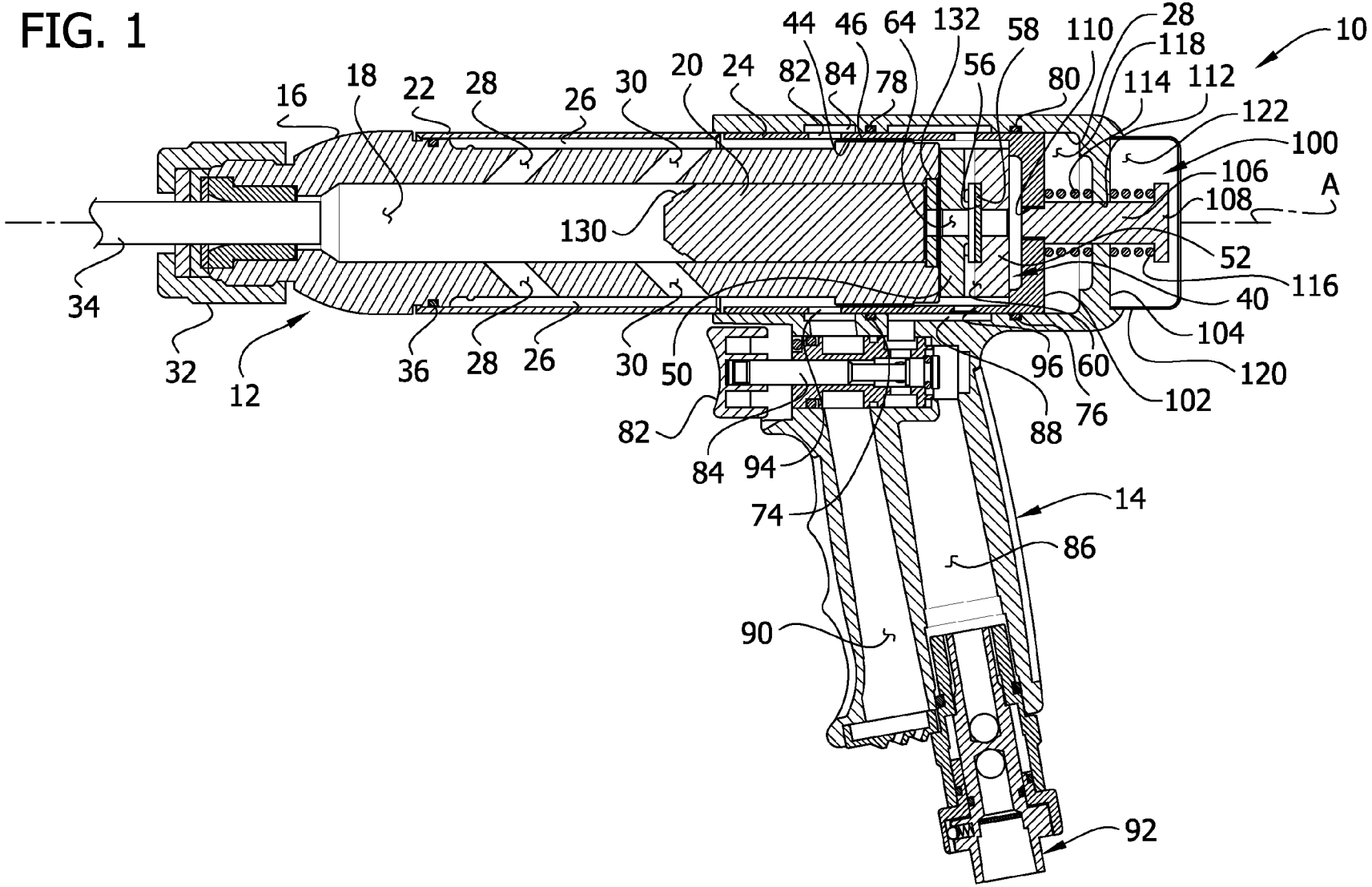
FIG. 1 is a vertical section of a pneumatic air hammer showing a mass at a beginning of a power stroke.
Figure 2:
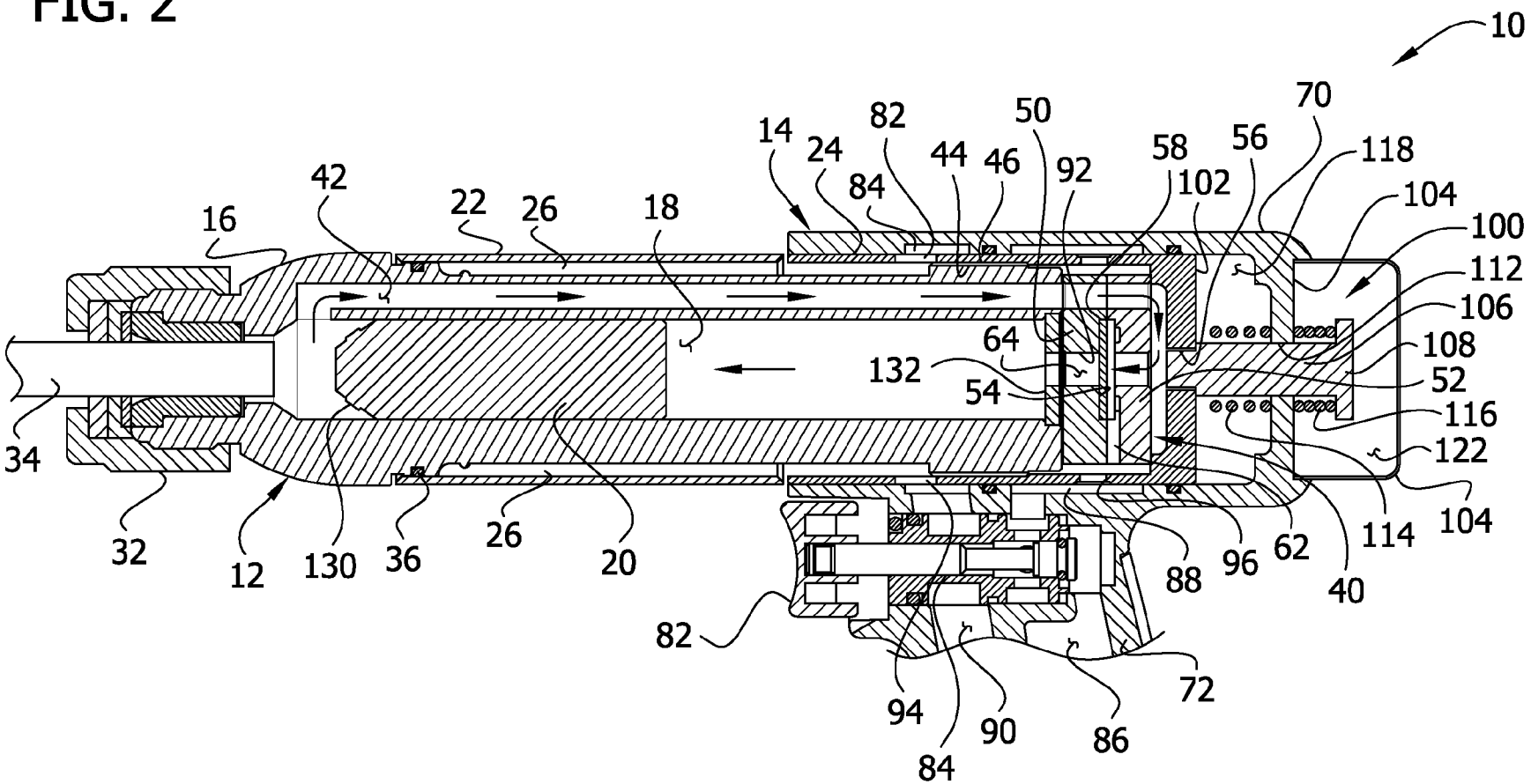
FIG. 2 is a fragmentary section of the air hammer having its barrel assembly rotated 90 degrees about its centerline from the orientation shown in FIG. 1 showing the mass during the power stroke.
Figure 3:
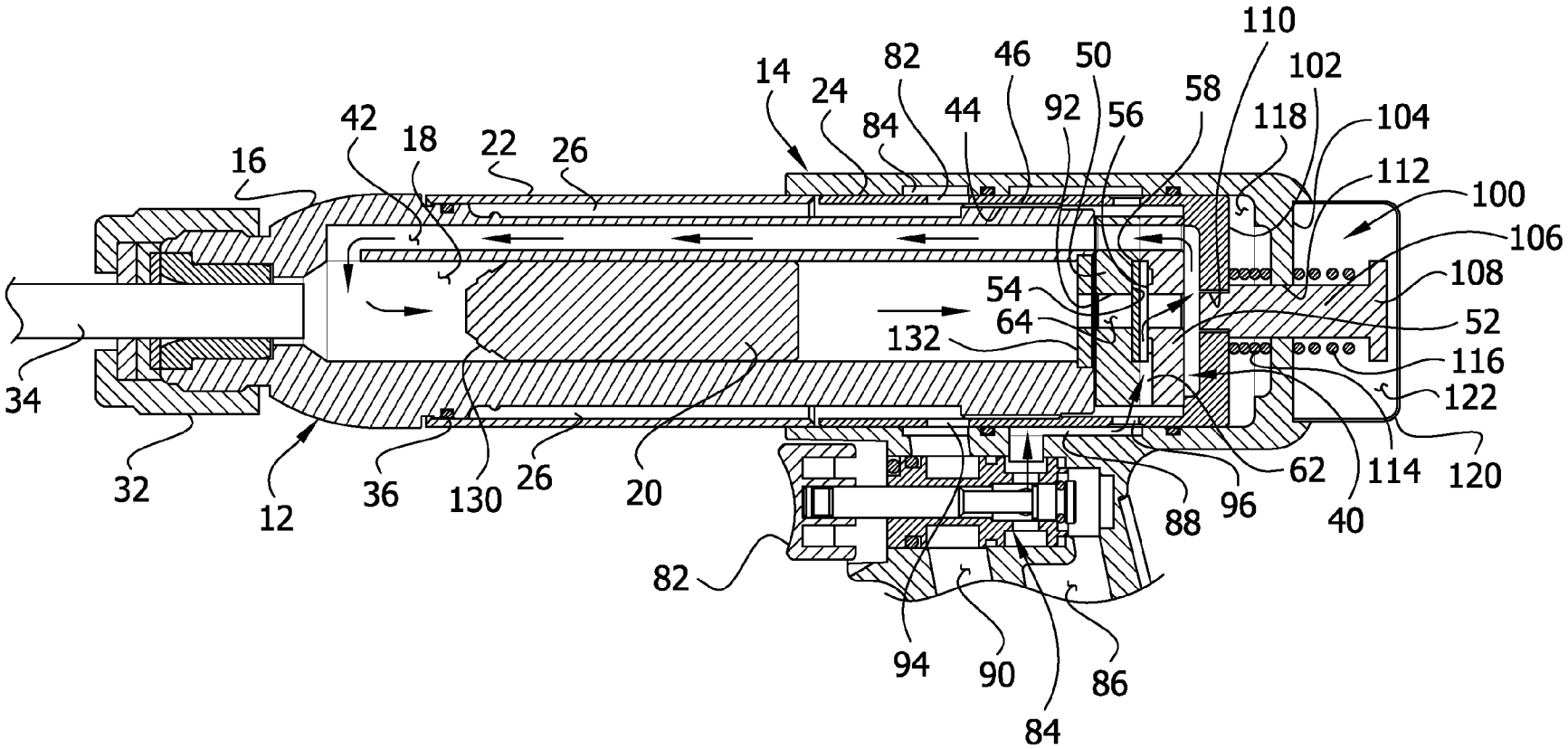
FIG. 3 is a fragmentary section of the air hammer similar to the orientation shown in FIG. 2 but showing the mass during a return stroke.

Referring to FIGS. 1-3, an air or pneumatic hammer (broadly, a fluid-driven hammer) designated generally by the reference number 10. The air hammer 10 comprises a barrel assembly, generally indicated at 12, secured to a body, generally indicated at 14. The barrel assembly 12 includes a hollow barrel 16 having a central longitudinal opening 18 and a mass 20 slidably received in the opening of the barrel. The barrel assembly 12 also includes a forward sleeve 22 and a rearward sleeve 24 surrounding corresponding portions of the barrel 16 to form an upstream portion of an exhaust passage 26 through the barrel assembly 12 as will be explained in greater detail below. As illustrated in FIG. 1, holes 28, 30 extend obliquely through the barrel 16 to allow air to pass between the barrel opening 18 and the exhaust passage 26. The barrel assembly 12 also includes a conventional chuck 32 for holding a tool 34 such as a chisel. Further, the barrel assembly 12 comprises an O-ring 36 for sealing a forward interface between the forward sleeve 22 and the barrel 16. A bi-directional valve assembly, generally designated by 40, provided at a rearward end of the barrel 16 alternately directs air through these different flowpaths formed between the barrel 16 and shells 22, 24 to oscillate the mass 20 back and forth between a power stroke (FIG. 2) and a return stroke (FIG. 3). As shown in FIG. 2, a control passage 42 extends through the barrel 16 and the valve assembly 40 to control operation of the valve as will be described in further detail below. The rearward sleeve 24 includes internal threading 44 corresponding to external threading 46 on the barrel 16 so the respective parts can be releasably joined together.

The valve assembly 40 includes forward and rearward housing portions 50, 52, respectively. Each housing portion 50, 52 has a corresponding valve seat 54, 56, respectively, that alternately receives a disk-shaped valve body 58 captured between the housing portions. Each seat 54, 56 is formed as an annular land surrounded by a groove in the corresponding half. Passages 60, 62 extend between each seat 54, 56, respectively, and a central opening 64 extending through both valve housing portions 50, 52 to direct air received from an external source (not shown) to opposite ends of the barrel opening 18 to drive the mass 20 back and forth.

The hammer body 14 comprises a tubular housing 70 adapted to slidably receive the barrel assembly 12 having a grip 72 for holding the hammer 10. The tubular housing 70 includes forward and rearward grooves 74, 76, respectively for receiving O-rings 78, 80, respectively, to seal an interface between the housing and the rearward sleeve 24. A trigger 82 mounted on the grip 72 controls a conventional valve, generally designated by 84, for selectively permitting air to travel through passages 86, 88 in the body 14 to the passages 60, 62 in the valve assembly 40. The body 14 also includes exhaust passages 90 communicating with the exhaust passages 26 in the barrel 16. A conventional swivel fitting and valve assembly, generally designated by 92, is provided at one end of the passage 86 in the body 14 for connecting the hammer 10 to a hose (not shown) carrying shop air. Because the trigger 82, valve 84 and passages 86, 88, 90 are conventional, they will not be described in further detail. An opening 94 is provided in the rearward sleeve 24 to permit flow between the exhaust passage 26 and the exhaust passage 90. Likewise, an opening 96 is provided in the rearward sleeve 24 to permit flow between the passage 88 and the passages 70, 72.

A shock absorbing system 100 is mounted between a rearward end 102 of the rearward sleeve 24 and a rearward end 104 of the tubular housing 70 of the hammer body 14. The system 100 includes a threaded stud 106 having a flange 108 at its rearward end. The stud 106 is threadably received by a hole 110 in the rearward end 102 of the rearward sleeve 24 and slidably extends through a hole 112 in the rearward end 84 of the tubular housing 70. A forward shock absorbing spring 114 is mounted on the stud 106 and captured between the rearward end 102 end of the rearward sleeve 24 and the rearward end 104 of the tubular housing 70. A rearward shock absorbing spring 116 is mounted on the stud 106 and captured between the rearward end 104 of the tubular housing 70 and the flange 108 of the stud 106. A forward generally sealed cavity 118 is formed between the rearward end 102 end of the rearward sleeve 24 and the rearward end 104 of the tubular housing 70. A threaded cap 120 is fastened to the tubular housing 70 over the stud 106 flange 108 to form a rearward generally sealed cavity 122. As will be appreciated by those skilled in the art, the springs 114, 116 and sealed cavity 118 act as shock absorbers to reduce shock transmitted between the barrel assembly 12 and the body 14. The volume of the cavity 118 and properties of the springs 114, 116 may be selected to tune the shock absorbing system 100 to minimize or optimize shock transmitted from the barrel 16 to the grip 72. Because those skilled in the art will appreciate how to size the cavities and springs, this procedure will not be described in detail.

In use, the mass 20 reciprocates back and forth inside the opening 18 of the barrel 16. A standard shop air hose (not shown) is connected to the fitting 92 prior to use. The valve body 58 may initially be seated against the forward seat 54 or the rearward seat 56. When the valve body 58 is seated against the rearward seat 56 as shown in FIG. 1 and the trigger 82 is depressed, air travels from the passage 86 through the valve 84, through the passage 88 and opening 96, though the passage 60 and opening 64 to push the mass 20 forward in the barrel opening 18. As the mass 20 moves forward, air in the opening 18 initially exits through the openings 28, 30 to the exhaust passage 26, eventually traveling through the exhaust passage 90 in the hammer body 14. As the mass 20 travels farther forward, it blocks air traveling through the opening 30, and then blocks air traveling through the opening 28. When both openings 28, 30 are blocked, air is forced through the passage 42 in the barrel 16 as shown in FIG. 2, moving the valve body 58 away from the rearward seat 56 and toward the forward seat 54, blocking the passage 60 (FIG. 1) and opening the passage 62. At the end of its forward motion, the mass 20 impacts the tool 34, causing the barrel 16 to move forward in the body 14, compressing the spring 116 and causing rapidly reduced pressure in the forward cavity 118.

When the valve body 58 is seated against the forward seat 54 and the trigger 82 is depressed, air travels from the passage 86 through the valve 84, through the passage 88 and opening 96, though the passage 62 and opening 64 to the passage 42 pushing the mass 20 rearward in the barrel opening 18 as shown in FIG. 3. As shown in FIGS. 1-3, the mass 20 may include a raised land 130 around its front surface to maintain a small void in front of the mass to permit air to pressurize the void to push the mass rearward even when against the tool 34 and front of the barrel 16. As the mass 20 moves rearward, air in the opening 18 initially exits through the openings 28, to the exhaust passage 26, eventually traveling through the exhaust passage 90 in the hammer body 14. As the mass 20 travels farther rearward, the openings 28 are blocked, but air continues to exit through the openings 30. Eventually, when the mass 20 blocks the openings 30, air is forced through the passage opening 64 in the valve 40 as shown in FIG. 2, moving the valve body 58 away from the forward seat 54 and toward the rearward seat 56, blocking the passage 62 and opening the passage 60 (FIG. 1). As will be appreciated by those skilled in the art, the valve and mass are again at the positions previously described and the cycle begins anew. In this way, the valve body 58 and mass 20 oscillate back and forth. At the end of its rearward motion, the mass 20 impacts a rearward end of the barrel 16, causing the barrel to move rearward in the body 14, compressing the spring 114 and causing rapidly increased pressure in the forward cavity 118. As shown in FIGS. 1-3, a compressible damping pad 132 may be positioned at the rearward end of the barrel 16 to reduce impact of the mass 20 striking the rearward end of the barrel.

When the hammer 10 is not in use, the barrel assembly 12 is in an at-rest position, as shown in FIG. 1. In the at-rest position, neither spring 114, 116 is compressed and no force is exerted on the barrel assembly 12. It should be understood that the springs 114, 116 may be partially compressed without departing from the scope of the present invention. Impulses caused by the mass 20 striking tool 34 are transferred to the barrel 16, causing the barrel to move or slide forward from its at-rest position in the housing chamber 70. The forward spring 114 compresses and decelerates the forward axial movement of the barrel assembly 12 to absorb shock caused by the impulse from the mass 20 striking the tool 34. Recoil impulses caused by the rearward end of the mass 20 striking the damping pad 132 during the return stroke are transferred to the barrel assembly 12, causing the barrel assembly to move rearward from its at-rest position in the housing chamber 70. The rearward spring 116 decelerates the rearward axial movement of the barrel assembly 12. In use the barrel assembly 12 oscillates forward and rearward from the at-rest position and the springs 114, 116 dampen and decelerate the respective axial movements to dampen vibration felt by the user.

Having described the invention in detail, it will be apparent that modifications and variations are possible without departing from the scope of the invention defined in the appended claims.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A power-driven hammer comprising:

a body including a tubular housing; and a barrel assembly received in the housing having an at-rest position relative to the housing when the hammer is not operating, the barrel assembly comprising:

a barrel having a forward end adapted to hold a tool, an opening, and a rearward end opposite the forward end; and a mass received in the opening of the barrel, the mass moving in the barrel opening when the hammer is operating through a power stroke, in which the mass moves toward the forward end of the barrel to strike the tool when held in the barrel, and a return stroke, in which the mass moves toward the rearward end of the barrel;

the barrel assembly moving forward and rearward from its at-rest position relative to the housing when the hammer is operating; and a vibration reducing mechanism connecting the barrel assembly to the body reducing shock transmitted to the housing as the mass moves forward and rearward in the barrel;

wherein the vibration reducing mechanism comprises a first reduction member configured to decelerate forward movement of the barrel assembly relative to the body and a second reduction member configured to decelerate rearward movement of the barrel assembly relative to the body, wherein the first reduction member comprises a first spring, and wherein the second reducing member comprises a second spring, and wherein the vibration reducing mechanism comprises a fastener secured to a rearward end of the barrel assembly and extending through an opening in the housing, said first spring being held by the fastener outside the housing and said second spring is held by the fastener inside the housing.

2. A power-driven hammer as recited in claim 1 further comprising a cap secured to a rearward end of the housing covering a portion of the fastener extending outside the housing.

3. A power-driven hammer as recited in claim 1 wherein at least one of said first reduction member and said second reduction member comprises a generally sealed cavity having an interior volume that changes in response to movement of the barrel assembly relative to the body housing.

4. A power-driven hammer as recited in claim 3 wherein the cavity is defined at least in part by a portion of the barrel assembly and the body housing.

5. A power-driven hammer as recited in claim 1 wherein the barrel assembly comprises a sleeve surrounding at least a portion of the barrel defining at least in part a passage surrounding the barrel.

6. A power-driven hammer as recited in claim 1 wherein the barrel assembly comprises a sleeve surrounding at least a portion of the barrel defining at least in part an inlet passage for delivering air to the barrel opening to move the mass forward and rearward in the opening and an exhaust passage for exhausting air from the barrel.

7. A power-driven hammer as recited in claim 6 wherein the barrel assembly further comprises a valve in fluid communication with both the inlet passage and the exhaust passage for directing flow through said inlet passage and exhaust passage.

8. A power-driven hammer comprising:

a housing;

a barrel assembly mounted on the housing having an at-rest position with respect to the housing when the hammer is not operating, the barrel assembly comprising:

a barrel having a forward end, an opening, and a rearward end opposite the forward end; and a mass moveably received in the barrel opening, the mass oscillating back and forth in the barrel opening between a power stroke and a return stroke;

the barrel assembly moving forward and rearward from its at-rest position relative to the housing when the hammer is operating; and a vibration reducing mechanism mounted between the barrel assembly and the housing comprising:

a fastener having a head mounted on the barrel assembly and slidably received by the housing;

a first spring held by the fastener between the barrel assembly and the housing; and a second spring held by the fastener between the housing and the head of the fastener.

9. A power-driven hammer as recited in claim 8 wherein the vibration reducing mechanism further comprises a generally sealed cavity having an interior volume that changes in response to movement of the barrel assembly relative to the housing.

10. A power-driven hammer as recited in claim 8 wherein the first spring absorbs shock resulting from an impact following the return stroke and the second spring absorbs shock resulting from an impact following the power stroke.

* * * * *